United States Patent [19]

Baumann

[11] Patent Number: 4,844,499

[45] Date of Patent: Jul. 4, 1989

[54] INTERCONNECTING JOINT FOR SKIS OR THE LIKE

[76] Inventor: Ernest F. Baumann, 1265 Park Ave. #2, Canon City, Colo. 81212

[21] Appl. No.: 183,870

[22] Filed: Apr. 19, 1988

[51] Int. Cl.[4] ..... A63C 5/02

[52] U.S. Cl. ..... 280/603; 403/345

[58] Field of Search ..... 280/603; 403/339, 340, 403/345

[56] References Cited

U.S. PATENT DOCUMENTS

| | | | |
|---|---|---|---|
| 3,596,918 | 8/1971 | Masuda | 403/339 X |
| 3,797,838 | 3/1974 | Shurgot et al. | 280/603 |
| 3,825,360 | 7/1974 | Galich | 403/294 |
| 4,405,150 | 9/1983 | Esper | 280/603 |
| 4,530,511 | 7/1985 | Brandt | 280/603 |

FOREIGN PATENT DOCUMENTS

| | | | |
|---|---|---|---|
| 87876 | 4/1922 | Austria | 280/603 |
| 742982 | 12/1943 | Fed. Rep. of Germany | 280/603 |
| 80543 | 3/1919 | Switzerland | 280/603 |

OTHER PUBLICATIONS

American Architect Time-Saver Standard, Finish Woodwork-Cabinet Work-1, Dec. 1936.

*Primary Examiner*—Charles A. Marmor
*Assistant Examiner*—Tamara L. Finlay
*Attorney, Agent, or Firm*—Henderson & Sturm

[57] ABSTRACT

An interconnecting joint for connecting one end of a first planar section to one end of a second planar section, each section end has a generally similar cross-sectional dimension at the interconnected ends. A longitudinally extending keyway in the first planar section has inwardly and downwardly angled sidewalls. A longitudinally extending key in the second planar section also has inwardly and downwardly angled sidewalls. The inwardly and downwardly angled sidewalls of the key matingly engage the angled sidewalls of the keyway when connected. Pins can be inserted into the angled and transverse bores for added stability.

1 Claim, 5 Drawing Sheets

10
12
26

14
16
18
20
22
24
28
30
32
34
36
38
44
46
50

INTERCONNECTING JOINT FOR SKIS OR THE LIKE

TECHNICAL FIELD

This invention relates to interconnecting joints for skis, and more particularly to an interconnecting joint for allowing collapsing of a ski and still having a rigid joint when the ski is assembled.

BACKGROUND ART

Skis are one of the most difficult sporting good items to transport because of their length. When transporting skis on a car top or trunk rack carrier, often times the skis will come loose and fly off the roof causing danger to other vehicles on the road. Also to replace a lost or broken ski can be very expensive. When travelling, wind sometimes causes problems when the transporting skis "buck" the wind. Also, when skis are transported on the exterior of a vehicle they are constantly exposed to the weather elements and the problem of theft is always present.

When carrying skis through an airport, the carrier must always be careful as to not turn quickly for fear of striking someone with his skis. Airlines provide special containers for shipment of the skis with the traveler. Without these special shipping containers one's skis are subject to rough handling in the baggage area, and expensive repair can result from improper handling.

When not in use, skis also present a storage problem. It is very difficult to find a suitable height in a closet or storage space to store the skis correctly.

Prior art sectioned joints for skis have been unsuccessful in that the section securing devices would protrude from the ski thus causing premature release during the ski run. The interconnecting joint was subject to failure because of stress at the joint or unsuitable securement of the joints. A latching device has also been tried for jointed skis, but this method has also proven to be unsatisfactory. Prior art joints have been unable to match the performance of the unjointed skis. Many prior art devices simply cut the ski in half and then tried to section the ski together with a latching device, only to find that there is not enough strength on the contact surface, causing the ski to come apart when used.

The military use skis for winter operations and find that when full length skis are transported and air-dropped some break upon impact and those that do not break are tangled with other ski equipment, such as ski poles and bindings.

Those concerned with these and other problems recognize the need for an improved collapsible, yet sturdy when assembled ski with no protruding securing devices.

DISCLOSURE OF THE INVENTION

The present invention provides an interconnecting joint for connecting one end of a first planar section to one end of a second planar section, each section end has a generally similar cross-sectional dimension at the interconnected ends. A longitudinally extending keyway in the first planar section has inwardly and downwardly angled sidewalls. A longitudinally extending key in the second planar section also has inwardly and downwardly angled sidewalls. The inwardly and downwardly angled sidewalls of the key matingly engage the angled sidewalls of the keyway when connected. Pins can be inserted into the angled and transverse bores for added stability.

An object of the present invention is the provision of an improved interconnecting joint for connecting one end of a first planar section to one end of a second planar section.

Another object of the present invention is to provide a interconnecting joint for skis that cannot come apart in the downward axis or the two directions involved in the lengthwise or horizontal direction.

A further object of the invention is the provision of an interconnecting joint for skis that spread the stress contact over an area of the joint.

Still another object is to provide a strengthing of the joint by means of insertion of pins into bores.

A still further object of the present invention is the provision of an interconnecting joint for a ski that is inexpensive to manufacture, easy to transport and simple to assemble and disassemble.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figures 1, 2, 3:
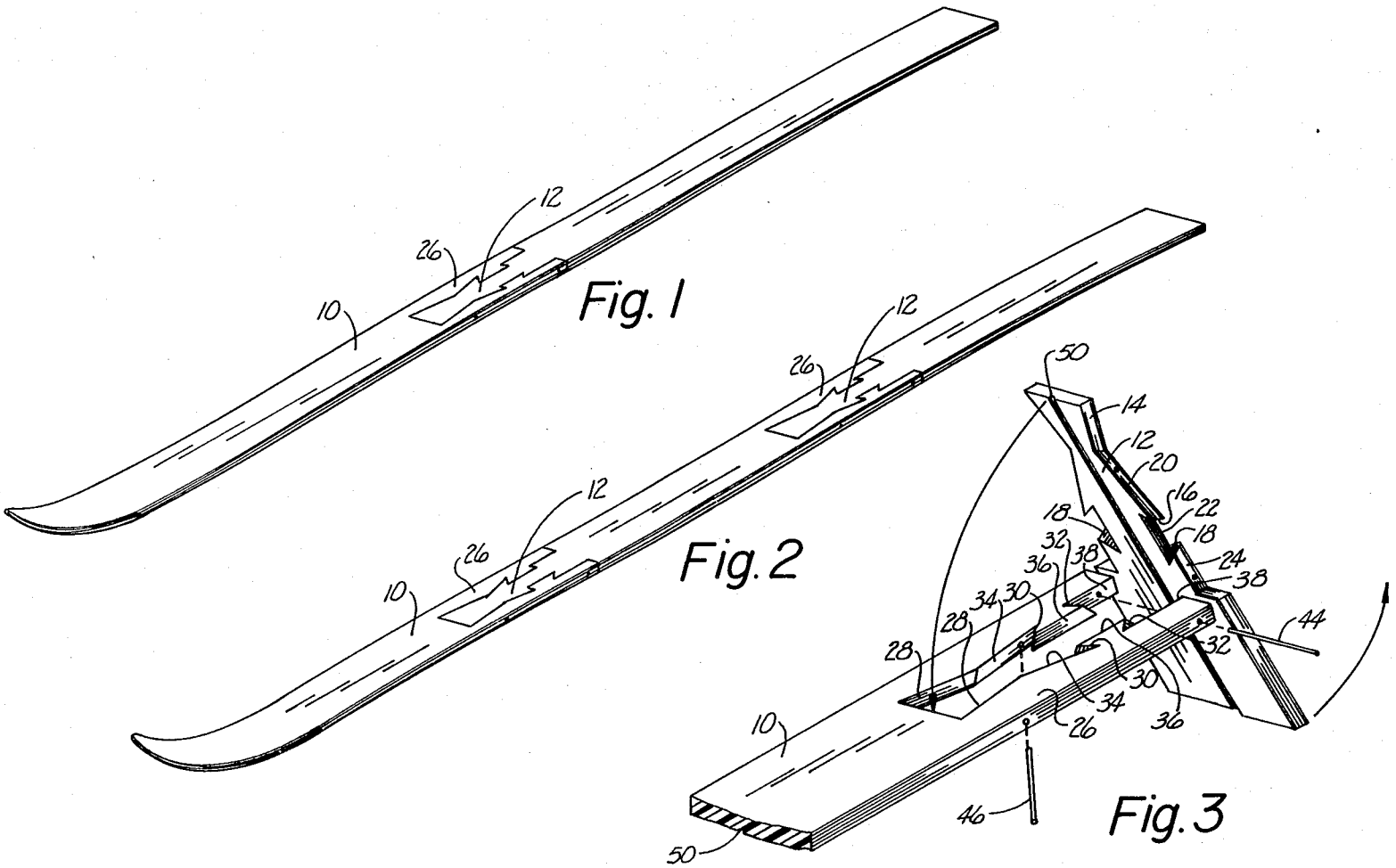
FIG. 1 is a perspective view of the interconnecting joint for a collapsible ski in its connected position.
FIG. 2 is a second embodiment of the interconnecting joint for a collapsible ski in its connected position, wherein the ski can be collapsed into three segments, instead of two.
FIG. 3 is a perspective view of the interconnecting joint of a collapsible ski shown in the collapsed position with the arrow indicating the preferred direction of insertion of the key into the keyway, and also showing placement of the optional securement pins.

Referring now to the drawings, wherein like reference numerals designate identical or corresponding parts throughout the several views, FIG. 3 shows an interconnecting joint of a collapsible ski in a collapsed position with the key (12) in an upright position with segments of inwardly and downwardly angled sidewalls (14, 16, 18) angled at 30 degrees on each side of the key (12). A plurality of segments of vertical sidewalls (20, 22, 24) on each side of the key (12) separate the angled sidewalls (14, 16, 18). The keyway (26) comprises segments of inwardly and downwardly angled sidewalls (28, 30, 32) angled at 30 degrees on each side of the keyway (26). A plurality of segments of vertical sidewalls (34, 36, 38) on each side of the keyway (26) separate the angled sidewalls (28, 30, 32).

Figure 5:
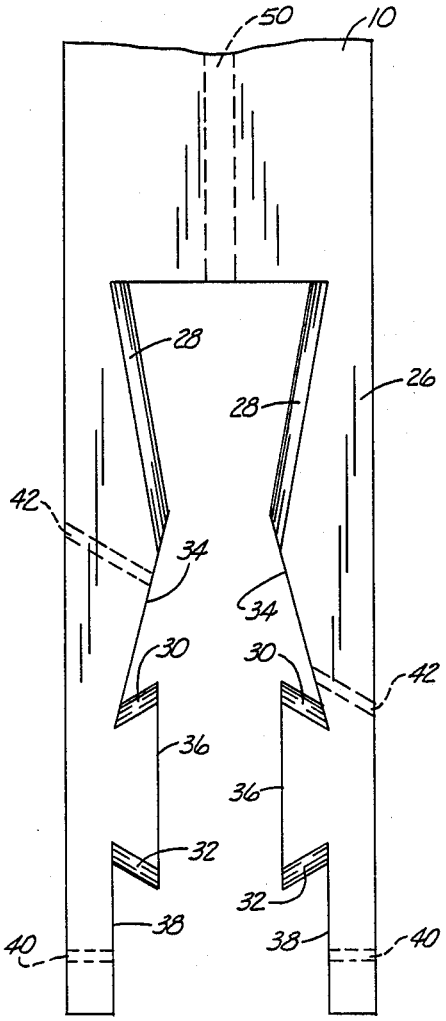
FIG. 5 is a top plan view of the keyway showing placement of the optional angled bore and optional transverse bore in dashed lines.
Figure 8:
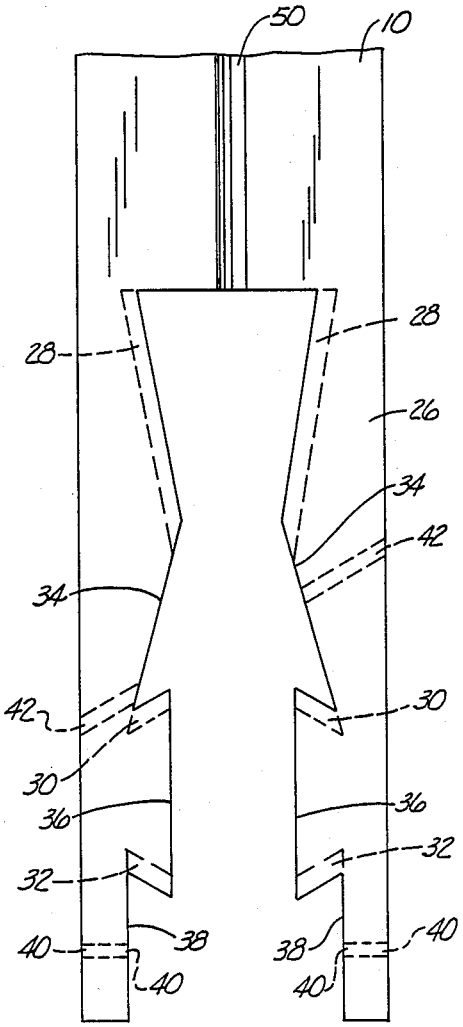
FIG. 8 is a bottom plan view of the keyway showing the top of the 30 degree angled walls in dashed lines, and showing the placement of the optional angled and transverse bores in dashed lines.
Figures 11, 12:
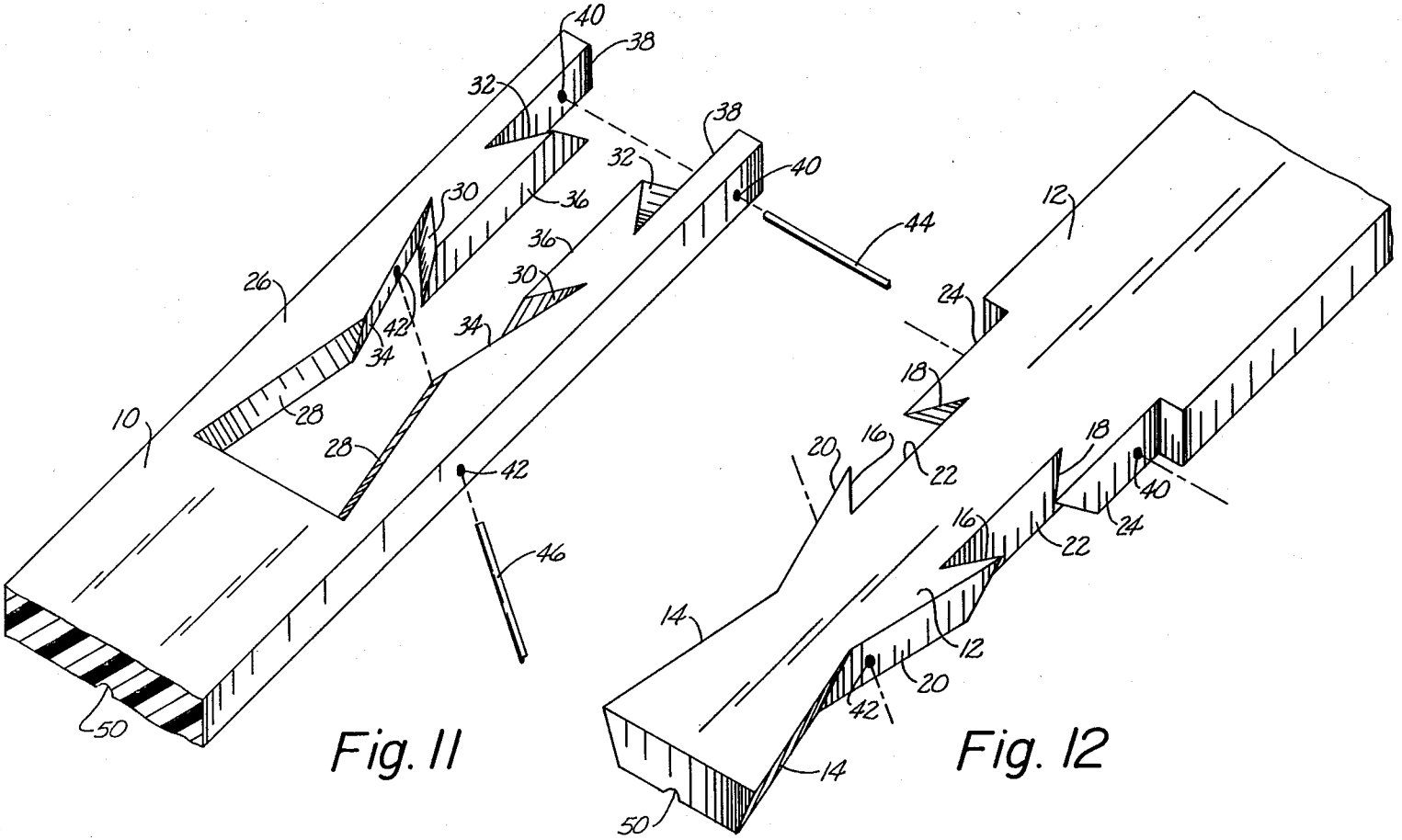
FIG. 11 is a perspective view of the keyway showing placement of the securing pins.
FIG. 12 is a perspective view of the key.

Referring now to FIGS. 5, 8, and 11, the transverse bore (40) extends through each side of the vertical sidewall (38) of the keyway (26). The angled bore (42) extends through each side of the vertical sidewall (34) of the keyway (26). In FIG. 11, pin (44) extends through sidewalls (38) of the transverse bore (40) of the keyway (26). Pin (46) extends through sidewalls (34) of the angled bore (42).

Figure 4:
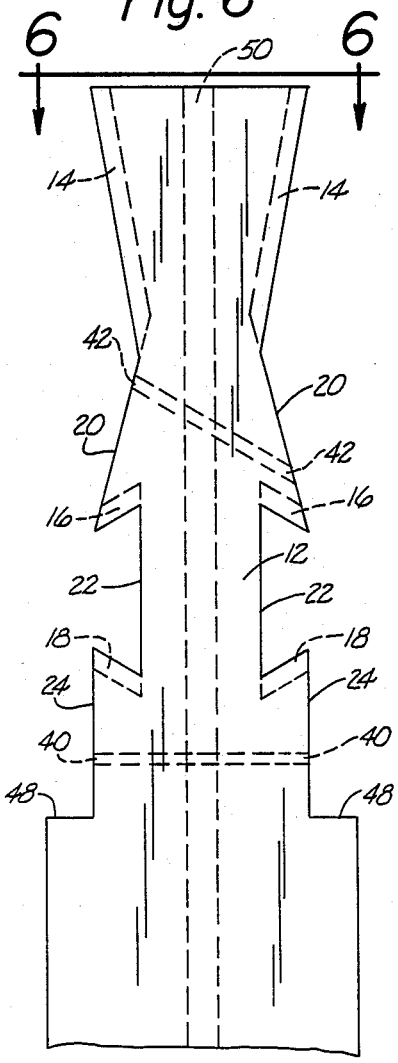
FIG. 4 is a top plan view of the key with the bottom of the 30 degree angled sidewalls being shown in dashed lines, the optional transverse bore and optional angled bore shown in dashed lines, and the center groove of the ski shown in longitudinal dashed lines.
Figure 7:
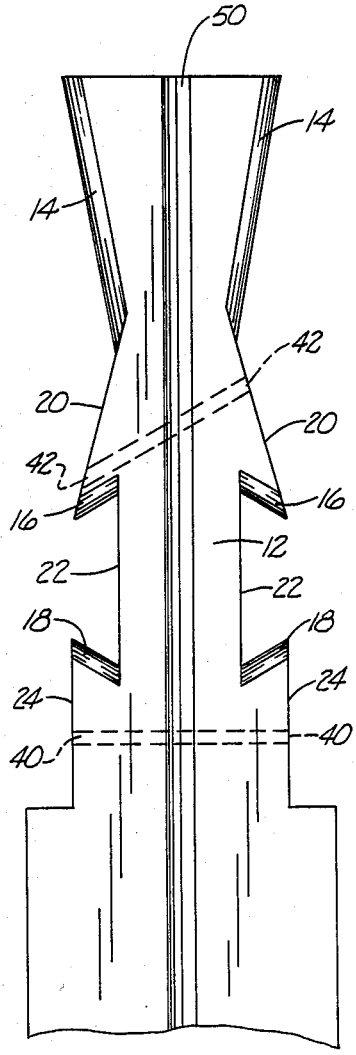
FIG. 7 is a bottom plan view of the key showing placement of the optional angled and transverse bores in dashed lines.

In FIGS. 4, 7, and 12, the transverse bore (40) extends through each side of the vertical sidewall (24) of the key (12). The angled bore (42) extends through each side of the vertical sidewall (20) of the key (12).

Figure 6:
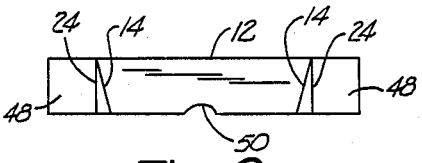
FIG. 6 is a end elevational view of the key taken along line 6—6 of FIG. 4.

FIG. 6 shows the angle of angled sidewall (14), vertical sidewall (24) and sidewall (48) of key (12) with groove (50) in the bottom of a typical ski (10).

Figure 9:
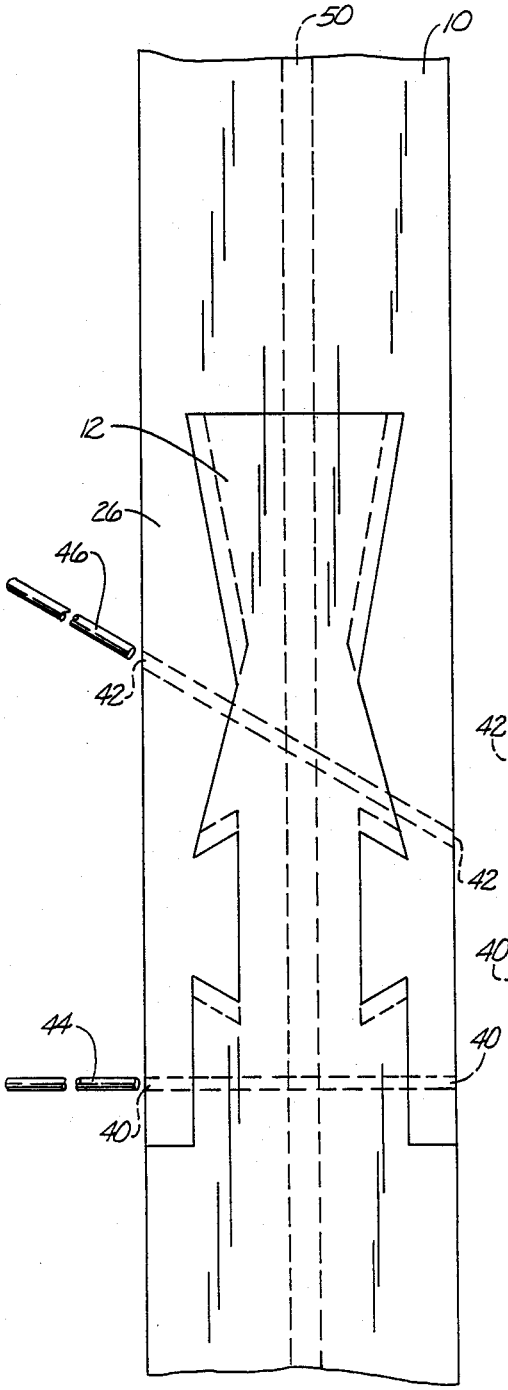
FIG. 9 is a top plan view of the assembled joint showing placement of the securing pins into the transverse and angled bores.
Figure 10:
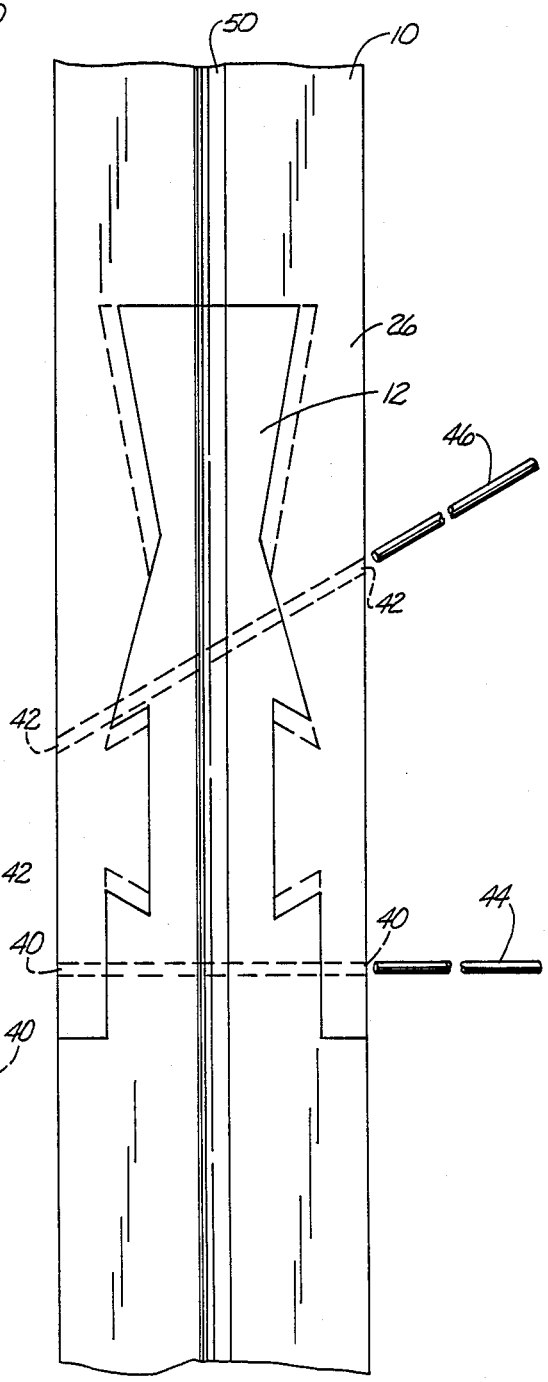
FIG. 10 is a bottom plan view of the assembled joint.

Finally, FIGS. 9 and 10 show the top and bottom of the assembled joint of a ski (10). FIG. 1 is the preferred embodiment of the joint; and FIG. 2 is another embodiment showing two interconnecting joints, instead of one.

In use, the key (12) is easily fit into the keyway (26) with a slight forward pushing motion to join the pieces together. The angled sidewalls (14, 16, 18) and vertical sidewalls (20, 22, 24) of key (12) are disposed to matingly receive the angled sidewalls (28, 30, 32) and vertical sidewalls (34, 36, 38) of the keyway (26). To secure the joint, pins (44, 46) are inserted into bores (40, 42) of the keyway (26) and key (12). To remove pins (44, 46), one simply inserts another pin (not shown) and shoves the pin (44, 46) completely through the bores (40, 42) and removes the pin from the opposite side of the ski. The ski is then collapsed for ease of transportation.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. An interconnecting joint for connecting one end of a first planar section to one end of a second planar section, each of said section ends having generally similar cross-sectional dimensions at the interconnected ends, wherein the first and second planar sections form a collapsible ski joint comprising:

a keyway having inwardly and downwardly angled sidewalls; and a key disposed to be matingly received within said keyway, said key having inwardly and downwardly angled sidewalls which matingly engage the angled sidewalls of said keyway wherein said keyway extends longitudinally in both the first and the second planar sections and the keyway and the key include a plurality of segments having angled sidewalls separated by segments having vertical sidewalls, a plurality of registered transverse bores extending through said key and said keyway; wherein, said plurality of registered transverse bores are angularly disposed relative to one another, and;

a plurality of securement pins extending through said plurality of registered transverse bores; wherein, one of said plurality of securement pins may be employed to dislodge the remainder of said securement pins from engagement with said registered transverse bores.

* * * * *

UNITED STATES PATENT AND TRADEMARK OFFICE

CERTIFICATE OF CORRECTION

PATENT NO. : 4,844,499

DATED : July 4, 1989

INVENTOR(S) : Ernst F. Baumann

It is certified that error appears in the above-identified patent and that said Letters Patent is hereby corrected as shown below:

On the title page inventor's should read

--Ernst F. Baumann--.

Signed and Sealed this

Thirteenth Day of March, 1990

*Attest:*

JEFFREY M. SAMUELS

*Attesting Officer*

*Acting Commissioner of Patents and Trademarks*